United States Patent [19]

Larson et al.

[11] 4,011,926

[45] Mar. 15, 1977

[54] STABILITY STEPLADDERS

[75] Inventors: Clayton E. Larson, Brooklyn, N.Y.; Edwin H. Lemp, Bellows Falls, Vt.

[73] Assignee: White Metal Rolling & Stamping Corporation, Brooklyn, N.Y.

[22] Filed: Apr. 12, 1976

[21] Appl. No.: 676,391

[52] U.S. Cl. ..... 182/107; 182/172

[51] Int. Cl.[2] ..... E06C 5/36; E06C 7/42

[58] Field of Search ..... 182/107, 108, 172

[56] References Cited

UNITED STATES PATENTS

| | | | |
|---|---|---|---|
| 3,508,628 | 4/1970 | Conrad | 182/172 |
| 3,933,221 | 1/1976 | Sorenson | 182/172 |

*Primary Examiner*—Reinaldo P. Machado
*Attorney, Agent, or Firm*—Carroll F. Palmer

[57] ABSTRACT

Stepladders having good lateral stability comprise a pair of channel members of fixed length pivoted at their top end to the side rails of the front ladder section to swing between a closed position and an extended position. The bottom ends of each channel member carries a foot member which always extends below the bottom end of the front section side rails so that the front section is supported in use of the ladder exclusively upon said foot members and not upon the bottom ends of the side rails.

6 Claims, 8 Drawing Figures

FIG. 1
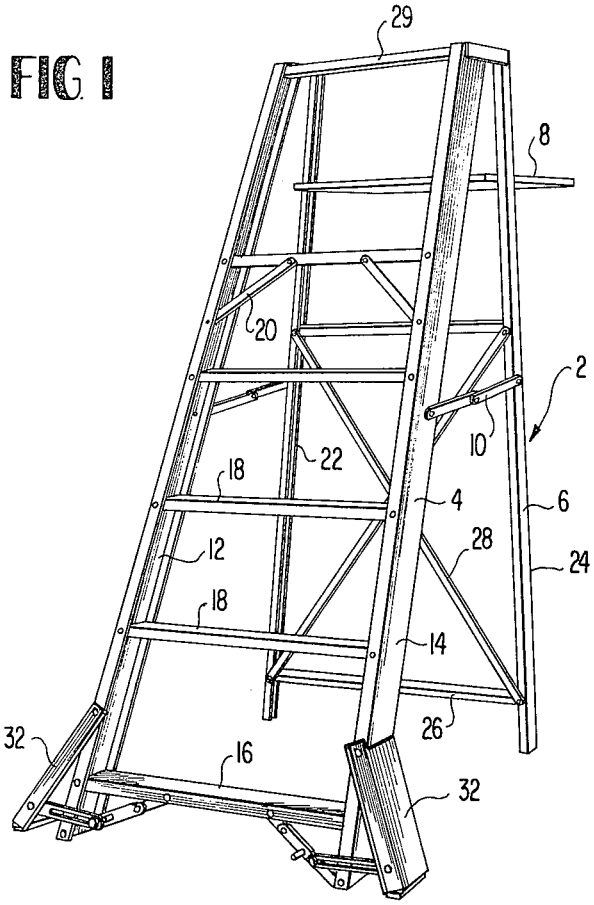
FIG. 4
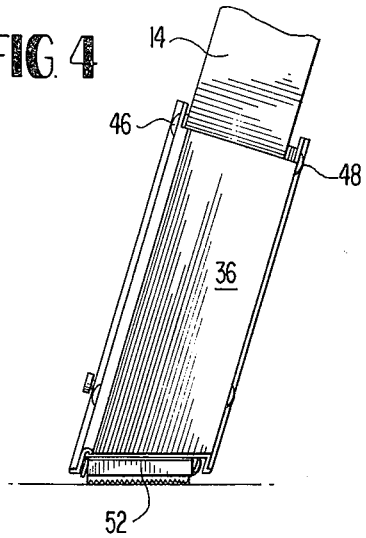
FIG. 7
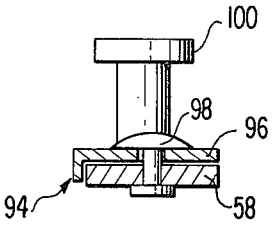
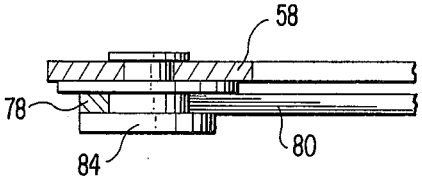
FIG. 8
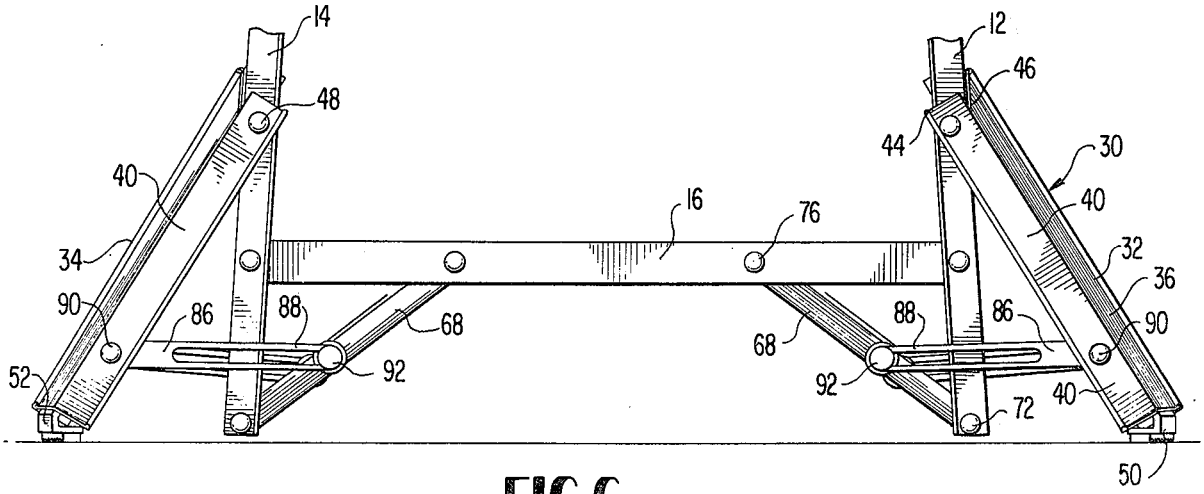
FIG. 6

FIG. 2
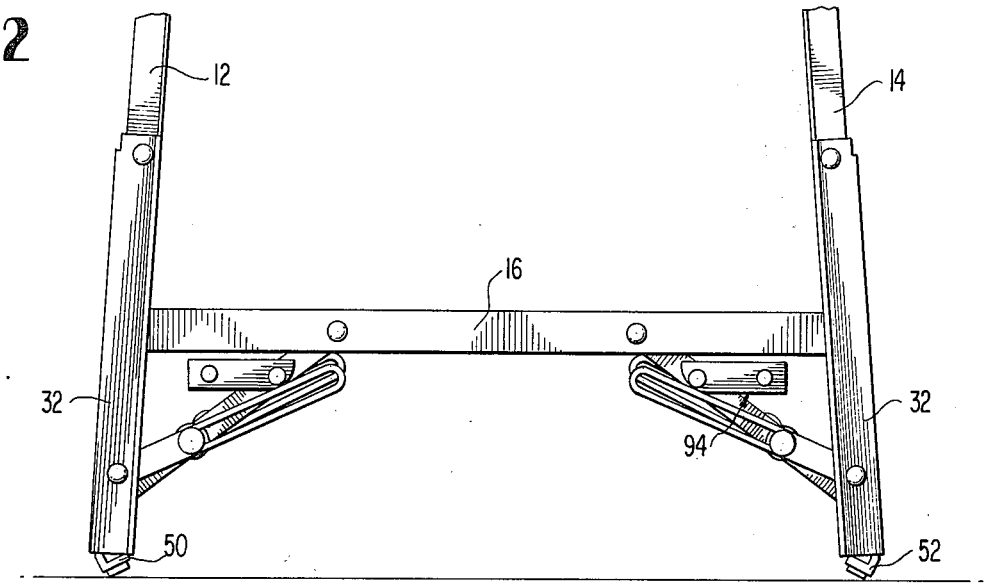
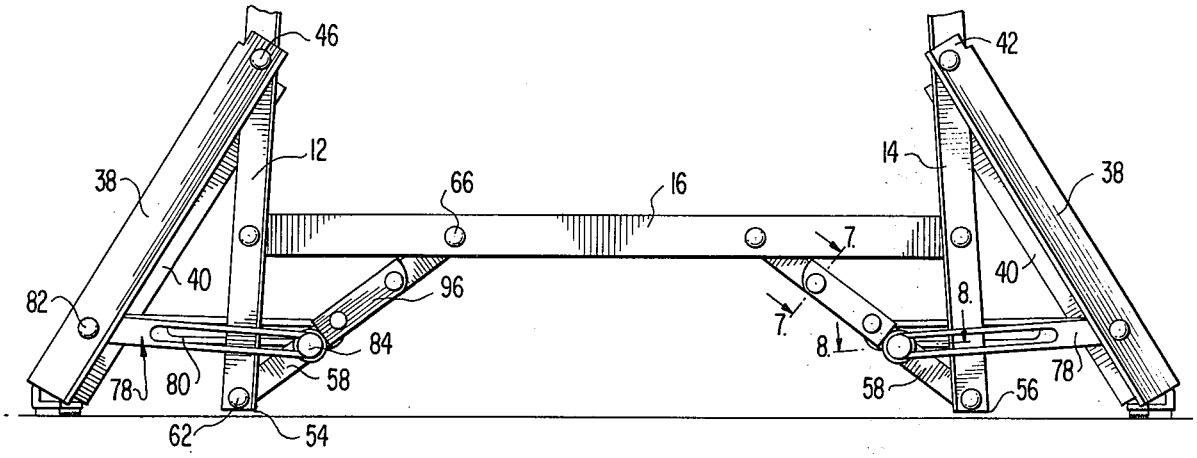
FIG. 3
FIG. 5
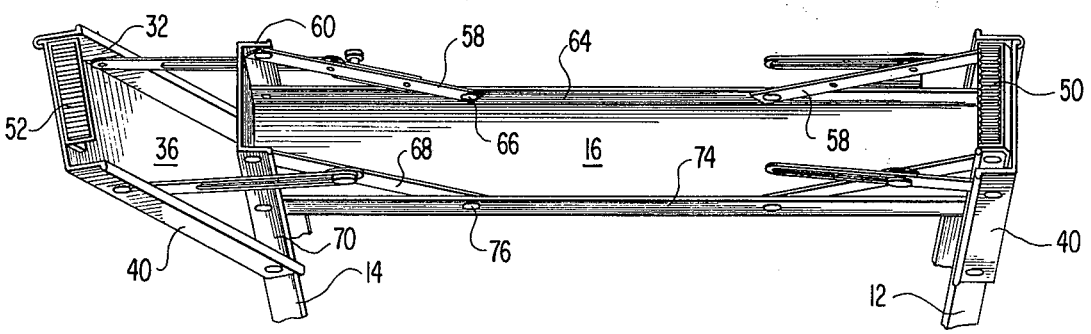

STABILITY STEPLADDERS

BACKGROUND OF THE INVENTION

1.Field of the Invention

This invention relates to stepladders. More particularly it concerns a new form of stepladder base designed to provide high lateral stability.

2. Description of the Prior Art

Although ladders are not rated high on the Consumer Product Safety Commission list of hazardous products, there is a need to improve upon their construction to diminish hazard to users. With stepladders, a prominate hazard is lack of lateral stability so that when a climber on the ladder reaches outward to perform a task or push laterally, the ladder may not resist both static and dynamic loading or shifting weight thereby resulting in a tilting accident.

It has been established that a primary element in stepladder stability is the total width of the ladder base. Another factor is the climbing height for any particular ladder size. Hence, stepladder stability can be improved by increasing the width of the base of a ladder, as opposed to adding to the length of its steps. Also, stability is increased by making the distance between the highest step on the ladder and its top a minimum of 18 inches.

It is known to provide ladders with outriggers to provide lateral stability as shown by U.S. Pat. Nos. 1,385,319; 3,508,628 and 3,891,054. Additional patents showing the state of development of the art includes:

| | | | |
|---|---|---|---|
| U.S. Pat. No. | 451,893 | 1,102,428 | 1,235,696 |
| | 485,900 | 1,135,336 | 1,415,791 |
| | 636,444 | 1,135,763 | 1,526,654 |
| | 1,610,596 | 2,324,414 | 2,997,127 |
| | 1,924,213 | 2,364,048 | 3,786,900 |

Not withstanding the numerous improvements in this field as indicated by the listed patents, there is need for further advance in the art. For example, many of the devices of the prior art unduly complicate the ladder structure. Also, many of them are cumbersome, are poor as to shipping space economy and subject to much shipping damage.

OBJECTS

A principle object of this invention is the provision of improved stability stepladders. Further objects include the provision of:

1. A new form of ladder base extension.
2. Stepladders that provide good lateral stability along with minimum prospects for shipping damage and high shipping space economies.
3. Stepladders having a folding base extension system that is easy to operate and that can be securely locked in an extended position to provide the full load-bearing function of the front section of the ladders.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the invention by an improvement for increasing the lateral stability of a stepladders which comprises:

a pair of channel members of fixed length having top and bottom ends, each said channel member having a foot member fixed to its bottom end, each channel member being pivoted at its top end upon a side rail of the front section of the ladder to swing between a closed position and an extended position, the point of pivot of the channel members being such that said foot members extend below the plane of the bottom ends of said front section side rails in both said closed and extended positions, and means to lock said channel in said extended position.

The improvement can be applied to ladders with parallel front side rails. In such cases, the rear propping section of the ladder may be provided with a pair of pivoted channel members structured as stated above.

The improvement may also be applied to ladders in which the side rails of the front section are not parallel, a so-called flared ladder.

The new ladders of the invention differ from related ladders of the prior art because the actual feet of the front section of the ladder that bear the entire load placed on the front section are exclusively and completely located on the channel members, i.e., the bottoms of the front side rails do not touch the support surface. Hence, the width of the base of the ladders is substantially increased without adding to the lengths of the steps or other structural members in the main body of the ladders.

BRIEF DESCRIPTION OF THE DRAWINGS

A more complete understanding of the new stepladders of the invention may be had by reference to the attached drawings in which:

FIG. 1 is a perspective view of a ladder constructed according to the invention, FIG. 2 is a fragmentary front view of the lower portion of the front section of the ladders.

FIG. 3 is similar to FIG. 2, but shows the channel members in an extended position.

FIG. 4 is a fragmentary side view corresponding to FIG. 2.

FIG. 5 is a bottom view of the front section of the ladder showing one channel member in extended position and the other in closed position.

FIG 6. is a rear view corresponding to FIG. 3.

FIG. 7 is an enlarged sectional view taken on the line 7—7 of FIG. 3.

FIG. 8 is an enlarged sectional view taken on line 8—8 of FIG. 3.

DESCRIPTION OF THE PREFERRED EMBODIMENTS

Referring in detail to the drawings, the stepladder 2 comprises a front section 4, a rear propping section 6, a folding bucket rack 8 and hinged spreaders 10.

The front section 4 includes a pair of side rails 12 and 14, a bottom step 16, a plurality of other steps 18 and braces 20.

The rear propping section 6 includes a pair of side rails 22 and 24, horizontal brace members 26 and angled brace members 28. The rear propping section 6 may be pivoted to the front section 4 upon an extension of the top step 29 as shown in FIG. 1 or on a lower lug member as shown in U.S. Pat. No. 3,009,535 the disclosure of which is incorporated herein by reference.

The novel means 30 of the invention for increasing lateral stability comprises a pair of channel members 32 and 34 each comprising a central web 36, an integral front web 38 and an integral rear web 40. The front and rear webs are longer than the central web 36 forming a pair of lugs 42 and 44 upon the upper end 46 of each channel member.

The inside distance between the webs 38 and 40 of each channel member is substantially equal to the width of the said rails 32 and 34 so that the lugs 42 and 44 may embrace the side rails. The channel members are pivoted on pins 46 and 48 extending through lugs 44.

Channel member 32 has a padded foot 50 fixed transversly upon its lower end. Similarly, channel member 34 is provided with the padded foot 52. The pivot pins 46 and 48 are positioned on the side rails 12 and 14 so that the padded feet 50 and 52, either in the closed position as seen in FIG. 2 or the open position as seen in FIG. 3, extend below the horizontal plane of the bottom ends 54 and 56 of their respective side rails 12 and 14.

Front brace members 58 are angled at each side of the front section 4 between the side rails 12 and 14 and the bottom step 16. These brace members 58 are fixed at one end to the inside of the forward edge 60 of each side rail 12 and 14 by rivets 62 and at the other end to the inside of the forward edge 64 of the bottom step 16 by rivets 66.

There are also rear brace members 68 angled between the side rails 12 and 14 and the bottom step 16. These brace members 68 are fixed at one end to the inside of the rearward edge 70 of each side rail 12 and 14 by rivets 72 and at the other end to the inside of the rearward edge 74 of the bottom step 16 by the rivets 76.

A pair of front arms 78 having longitudinal slots 80 are pivoted on rivets 82 carried by the front webs 38 of the channel members. Capped lugs 84 carried by the front brace members 58 extend through the slots 80 and limit the movement of the channel members in the extended position as seen in FIG. 3.

A pair of rear arms 86 having longitudinal slots 88 are pivoted on rivets 90 carried by the rear webs 40 of the channel members. Capped lugs 92 carried by the rear brace members 68 extend through the slots 88 and assist lubs 84 in limiting the extension of the channel members 32.

Moveable stop members 94 are provided to engage a pair of the slotted arms 58 or 68 to lock the channel members 32 in the extended position. The stop members 94 comprise angle sections 96 pivoted by rivets 98 to the face of the brace members 58 to move between an unlocked position (FIG. 2) and a locking position (FIG. 3) where the unpivoted ends of the sections 96 abut the respective unpivoted end to the slotted arms 78. Knobs 100 are fixed to the sections 96 to assist in moving the stop members 94 between locking and unlocked positions.

CONCLUSION

The new ladder structures as described provide a new form of ladder base extension, not simply a safety outrigger or stabilizer. The overall load bearing base is a prime criteria of ladder stability. The folding devices of this invention transfer the entire load on the ladder to the extremities of the extended structure so that in effect the width of the base of the ladder is substantially increased without adding to the length of the steps or other structural members in the main body of the ladder. Since the structure is retractable, the new ladders provide for good shipping economies and mitigate shipping damage. Furthermore, the structures are simple to operate. Also, because of the way in which the load is applied to the padded feet in the new ladders, the channel members will safely remain in the extended position with the ladder under load of the weight of a user even should the user fail to depress the lock members into the locking position.

The embodiments of the invention in which an exclusive property or privilege is claimed are defined as follows:

1. A stepladder having high stability against lateral tilting comprising:

a front section including a pair of side rails with a bottom step and a plurality of other spaced apart steps fixed between the side rails;

a rear propping section including a pair of side rails and brace members for holding the side rails in spaced apart relation, said rear propping section being pivoted to said front section;

a pair of channel members each comprising a central web and a pair of integral front and rear webs extending normally from the central web, said front and rear webs being longer than the central web forming a pair of lugs upon one end of each channel member;

the inside distance between said front and rear webs of said channel members being substantially equal to the width of the side rails of said front section;

a padded foot member fixed transversely of each channel member at the end opposite to said lugs;

said channel members being pivoted by said lugs to said side rails above said bottom step to swing outwardly from said side rails between a closed position and an extended position, the pivot point for said channel members being such that said padded foot members extend in both said closed and said extended positions beyond the lower end of said front section side rails;

front brace members angled at each side of said front section between the forward edge of each side rail and the forward edge of said bottom step;

rear brace members angled at each side of said front section between the rearward edge of each side rail and the rearward edge of said bottom step;

a pair of front and a pair of rear slotted arms pivoted upon said front and rear webs respectively of each channel member;

capped lugs carried by each of said front and rear brace members, said lugs extending through the slots in said arms to limit the movement of said channel members in the extended position, and moveable stop members to engage at least one of said pairs of slotted arms to lock said channel members in the extended position.

2. The stepladder of claim 1 wherein the side rails of said front section and rear propping section are parallel.

3. The stepladder of claim 2 wherein said rear propping section carries a pair of pivoted channel members structured as defined in claim 1 to swing between a closed position and an extended position.

4. The stepladder of claim 1 wherein the side rails of said front section are wider apart at the bottom of the ladder than at the top.

5. The stepladder of claim 1 wherein said moveable stop members are pivoted at one end upon said front brace members to enable the opposite end of each stop member to abut the respective unpivoted end of a slotted arm to provide said locking of said channel members.

6. In a stepladder having a front section including a pair of side rails with a bottom step and a plurality of other spaced apart steps fixed between the side rails and a rear propping section pivoted to said front, the improvement for increasing the lateral stability of the stepladder which comprises:

a pair of one piece channel members of fixed length having top and bottom ends, each said channel member having a foot member fixed to its bottom end;

each channel member being pivoted at its top end upon a side rail of said front section to swing between a closed position and an extended position, the point of pivot of the channel members being such that said foot members extend below the plane of the bottom end of said front section side rails in both said closed and extended positions;

and means to lock said channel members in said extended position.

* * * * *